US007857741B1

(12) United States Patent
Hsiung

(10) Patent No.: US 7,857,741 B1
(45) Date of Patent: Dec. 28, 2010

(54) COMBINATION ABDOMINAL CRUNCH AND GRAVITY INVERSION EXERCISE MACHINE

(75) Inventor: Bob Hsiung, Walnut, CA (US)

(73) Assignee: Body Flex Sports, Inc., Walnut, CA (US)

( * ) Notice: Subject to any disclaimer, the term of this patent is extended or adjusted under 35 U.S.C. 154(b) by 0 days.

(21) Appl. No.: 12/653,174

(22) Filed: Dec. 8, 2009

(51) Int. Cl.
*A63B 26/00* (2006.01)

(52) U.S. Cl. ..... 482/145; 482/144; 482/143

(58) Field of Classification Search ..... 482/140, 482/148, 143–144; 601/5; D21/662, 686, D21/690

See application file for complete search history.

(56) References Cited

U.S. PATENT DOCUMENTS 5,180,161 A * 1/1993 Jordan ..... 482/143
5,669,865 A * 9/1997 Gordon ..... 482/142
5,718,660 A * 2/1998 Chen ..... 482/144
5,967,956 A * 10/1999 Teeter ..... 482/144
7,052,448 B2 * 5/2006 Teeter ..... 482/144
7,063,652 B1 * 6/2006 Teeter et al. ..... 482/145
7,118,518 B1 * 10/2006 Teeter ..... 482/144
7,125,372 B1 * 10/2006 Teeter et al. ..... 482/144
7,179,212 B2 * 2/2007 Hsiung et al. ..... 482/140
7,361,128 B2 * 4/2008 Chen ..... 482/144
7,374,520 B1 * 5/2008 Licari ..... 482/144
D582,495 S * 12/2008 Lindblad ..... D21/690
7,500,939 B2 * 3/2009 Chen ..... 482/144
7,507,192 B2 * 3/2009 Teeter et al. ..... 482/144
7,544,157 B2 * 6/2009 Teeter et al. ..... 482/144
7,546,809 B2 * 6/2009 Chen ..... 108/6
7,585,263 B2 * 9/2009 Brown et al. ..... 482/142
7,585,264 B1 * 9/2009 Wang et al. ..... 482/144
7,611,445 B2 * 11/2009 Brown et al. ..... 482/51
7,625,326 B2 * 12/2009 Teeter et al. ..... 482/144
7,625,327 B1 * 12/2009 Teeter et al. ..... 482/144
2003/0153442 A1 * 8/2003 Kuo ..... 482/144
2006/0046915 A1 * 3/2006 Huang ..... 482/145
2009/0054216 A1 * 2/2009 Teeter ..... 482/144
2009/0054217 A1 * 2/2009 Teeter ..... 482/144

* cited by examiner

*Primary Examiner*—Lori Baker
(74) *Attorney, Agent, or Firm*—Thomas I. Rozsa

(57) ABSTRACT

A combination gravity inversion exercise machine and abdominal crunch exercise machine which enables a user to perform both exercises in one machine. The machine enables a user to save exercise floor space and perform the two different exercises on the same machine to thereby make an exercise session more efficient. The machine combines the features of a gravity inversion machine which enables a user to lie inverted for a period of time to take pressure off the back muscles and also has the features of an abdominal crunch which enables a user to exercise and tighten stomach muscles.

6 Claims, 6 Drawing Sheets

COMBINATION ABDOMINAL CRUNCH AND GRAVITY INVERSION EXERCISE MACHINE

BACKGROUND OF THE INVENTION

1. Field of the Invention

The present invention relates to the field of exercise machines and in particular to exercise machines which help alleviate back pain by causing the body to lie inverted for a period of time to take pressure off the back muscles and also to exercise machines which enable a user to perform abdominal crunch exercises to tighten stomach muscles and reduce the user's waistline.

2. Description of the Prior Art

In general, there are numerous types of exercise machines on the market. One type of machine is a gravity inversion machine which enables a user to be supported on the machine and then by shifting the user's weight, causing the machine to rotate so that the user is supported with the user's head projecting toward the ground and the user's feet in the air to invert the posture of the user. This enables the user to take pressure off the user's back muscles and spine to help reduce back pain.

There are also individual abdominal crunch machines on the market which enable a user to raise the user's feet toward his/her chest or enable the user to bend forward while the user is seated to thereby exercise the user's abdominal muscles to strengthen the user's abdominal muscles and reduce the user's weight.

However, there is no combination machine which combines the above two features. There is a significant need for such a machine to enable a user to save exercise floor space and perform the two different exercises on the same machine to thereby make an exercise session more efficient.

SUMMARY OF THE INVENTION

The present invention is a combination gravity inversion exercise machine and abdominal crunch exercise machine which enables a user to perform both exercises in one machine. The machine enables a user to save exercise floor space and perform the two different exercises on the same machine to thereby make an exercise session more efficient. The machine combines the features of a gravity inversion machine which enables a user to lie inverted for a period of time to take pressure off the back muscles and also has the features of an abdominal crunch which enables a user to exercise and tighten stomach muscles.

One portion of the present invention exercise machine is a gravity inversion machine which enables a user to be supported on the machine and then by shifting the user's weight, causing the machine to rotate so that the user is supported with the user's head projecting toward the ground and the user's feet in the air to invert the posture of the user. This enables the user to take pressure off the user's back muscles and spine to help reduce back pain. The machine can also be rotated so that user is resting on the machine in an almost horizontal position with the user's legs held tightly so that the user can rotate his/her torso toward his/her legs to exercise the user's upper stomach muscles. The user can also support himself/herself on the machine to enable the user to raise his/her legs toward's his/her torso to also exercise the user's lower abdominal muscles.

It is therefore an object of the present invention to provide a combination gravity inversion exercise machine and abdominal crunch exercise machine which enables a user to perform both exercises in one machine. The machine enables a user to save exercise floor space and perform the two different exercises on the same machine to thereby make an exercise session more efficient. The machine combines the features of a gravity inversion machine which enables a user to lie inverted for a period of time to take pressure off the back muscles and also has the features of an abdominal crunch which enables a user to exercise and tighten stomach muscles.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
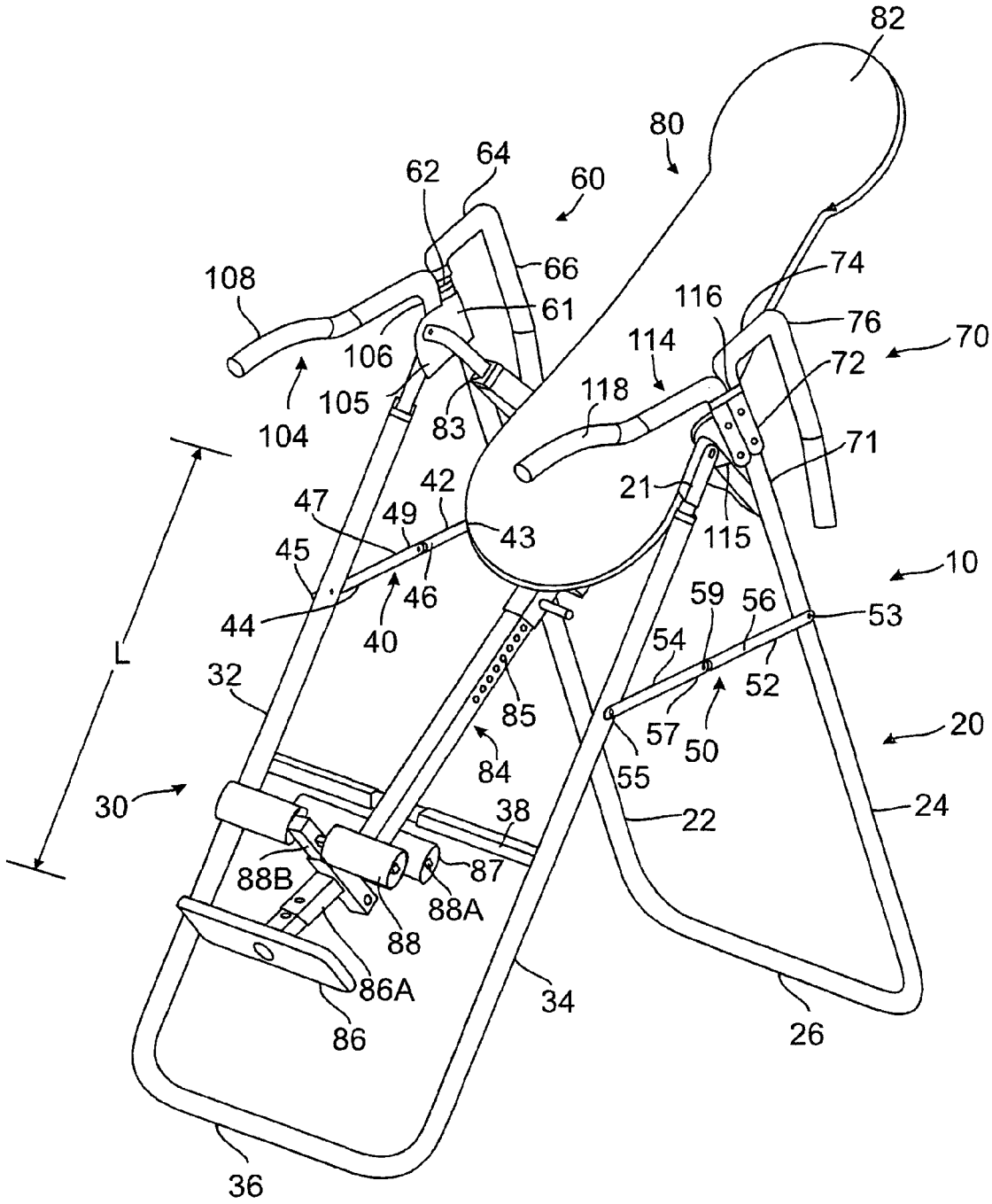
FIG. 1 is a perspective view of the present invention combination abdominal crunch and body inversion exercise machine set up for an inversion exercise.

Referring to FIG. 1, there is illustrated a perspective view of the present invention combination abdominal crunch and body inversion exercise machine 10 set up for an inversion exercise. In this configuration, the machine 10 is comprised of a first support angle leg section 20 having a first longitudinal section 22, a parallel and spaced apart second longitudinal section 24 and a bottom interconnecting section 26. The machine 10 is also comprised of a second support angle leg section 30 having a first longitudinal section 32, a parallel and spaced apart second longitudinal section 34 a bottom interconnecting section 36 and an intermediate cross-bar connecting section 38. The two support angle leg sections 20 and 30 are interconnected by first hinged connecting member 40 having a first bar 42 with a distal end 43 connected to first longitudinal section 22 of first support angle leg section 20, a second bar 44 with a distal end 45 connected to first longitudinal section 32 of second support angle leg section 30 and a hinge member 49 interconnecting respective proximal ends 46 and 47 of bars 42 and 44. Similarly, the two support angle leg sections 20 and 30 are interconnected by second hinged connecting member 50 having a first bar 52 with a distal end 53 connected to second longitudinal section 24 of first support angle leg section 20, a second bar 54 with a distal end 55 connected to second longitudinal section 34 of second support angle leg section 30 and a hinge member 59 interconnecting respective proximal ends 56 and 57 of bars 52 and 54. First inversion handle bar 60 is connected to a plate 61 located at an upper end of first longitudinal section 22 and has a connecting portion 62, a horizontal portion 64 and a longitudinal gripping portion 66. Second inversion handle bar 70 is connected to a plate 71 located at an upper end of first longitudinal section 32 and has a connecting portion 72, a horizontal portion 74 and a longitudinal gripping portion 76. First abdominal crunch handle bar 104 is connected to a plate 105 located at an upper end of second longitudinal section 24 and has a connecting portion 106 and a longitudinal gripping portion 108. Second abdominal crunch handle bar 114 is connected to a plate 115 located at an upper end of second longitudinal section 34 and has a connecting portion 116 and a longitudinal gripping portion 118.

Rotatably supported between the supporting angle leg sections 20 and 30 is a back support 80 having a pad 82 and a horizontal member rotatably connected to plates 21 and 31 on respective support angle leg sections 20 and 30. Extending from the back support 80 is a height adjustment leg tube 84 terminating in a foot plate 86 and having at least one and preferably two foot retaining members 87 and 88 spaced apart from foot plate 86. The foot plate 86 is adjustably affixed to foot plate adjustment bar 86A. Foot retaining member 87 is supported on dowel 88A which extends through height adjustment leg tube 84. Foot retaining member 88 is supported on dowel 88BB which extends through adjustable transverse bar 88B. The height adjustment leg tube 84 has adjustment member 85 whereby the length "L' to the height adjustment tube can be increased or decreased to accommodate the length of the user's legs. The height adjustment leg tube 84 also rests on intermediate cross-bar connecting section 38.

Figure 2:
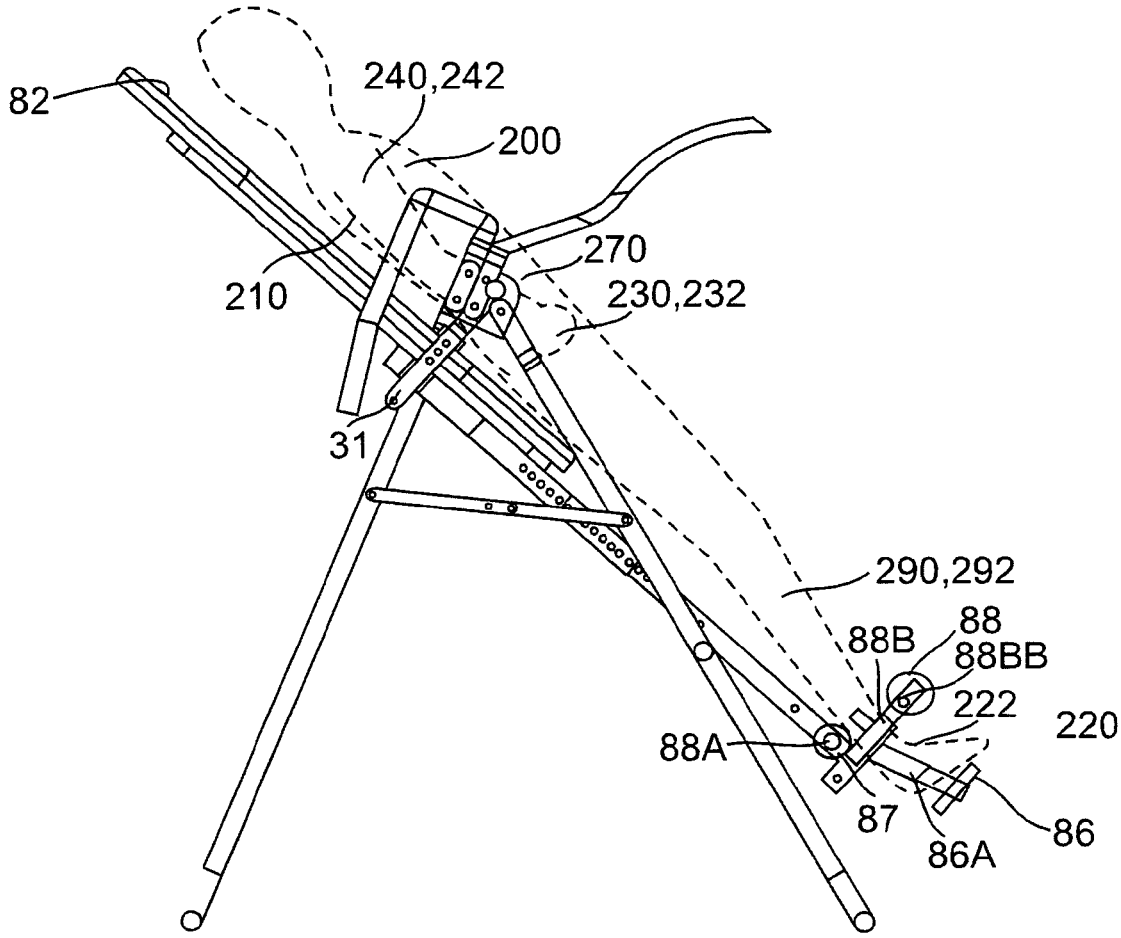
FIG. 2 is a side view of a user on the present invention exercise machine with the machine in the starting position for an inversion exercise work out, the user lying with his/her back against a back support with arms adjacent the user's side and the user's feet secured in foot supports.

Referring to FIG. 2, there is illustrated a side view of a user 200 on the present invention exercise machine 10 with the machine in the starting position for an inversion exercise work out. The user's back 210 rests against the pad 82 of back support 80 and the user's feet 220 and 222 rest on foot plate 86 with the user's feet retained between foot retaining members 87 and 88. The user's legs 290, 292 extend away from the back support 80.

Figure 3:
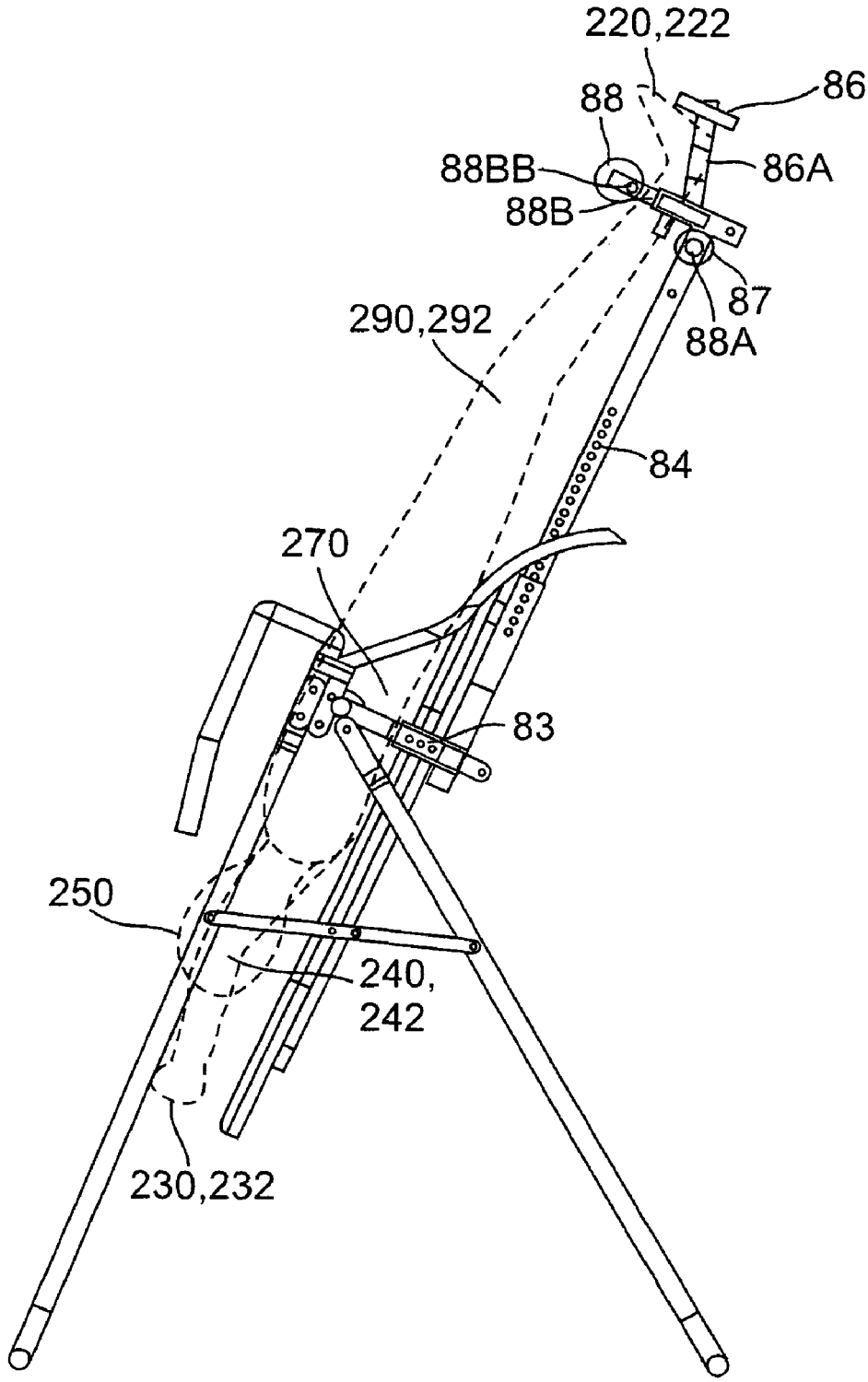
FIG. 3 is a side view of a user on the present invention exercise machine with the machine in the fully inverted position for a full inversion exercise work out, with the user's arms extending adjacent opposite sides of the user's head.

Referring to FIG. 3, there is illustrated a side view of a user on the present invention exercise machine 10 with the machine in the fully inverted position for a full inversion exercise work out. The user's hands 230 and 232 and arms 240, 242 respectively start at an initial position on the side of the body 270. The user 200 raises one arm (240, 242) at a time to initiate the inversion exercise workout. The user can grip the longitudinal gripping portion 66 and 76 of the inversion handle bars 60 and 70 with the user's hands 230 and 232 to help assist during the inversion exercise workout. The back arm handlebars 60 and 70 are used to assist the user 200 in case the user 200 is not familiar with the system or it is also used to bring the user's hands back to the initial position. It is not mandatory for the user 200 to use the back arm handle bars 60 and 70 for the inversion system. The handle bars 60 and 70 are only there for any additional assistance that may be required.

The user 200 causes his/her weight to shift so that the horizontal member 83 is rotated so that back support 80, height adjustment leg tube 84, foot plate 86 and foot retaining members 87 and 88 are rotated so that the user 200 is supported with the user's head 250 projecting toward the ground and the user's feet 220 and 222 are in the air to invert the posture of the user 200. The user's arms 240 and 242 are adjacent opposite sides of the user's support 80, height adjustment leg tube 84, foot plate 86 and foot retaining members 87 and 88 are returned to the position as illustrated in FIG. 2 so that user is in the normal angled position with the user's feet 220, 222 adjacent the ground and the user's head 250 in the air.

Figure 4:
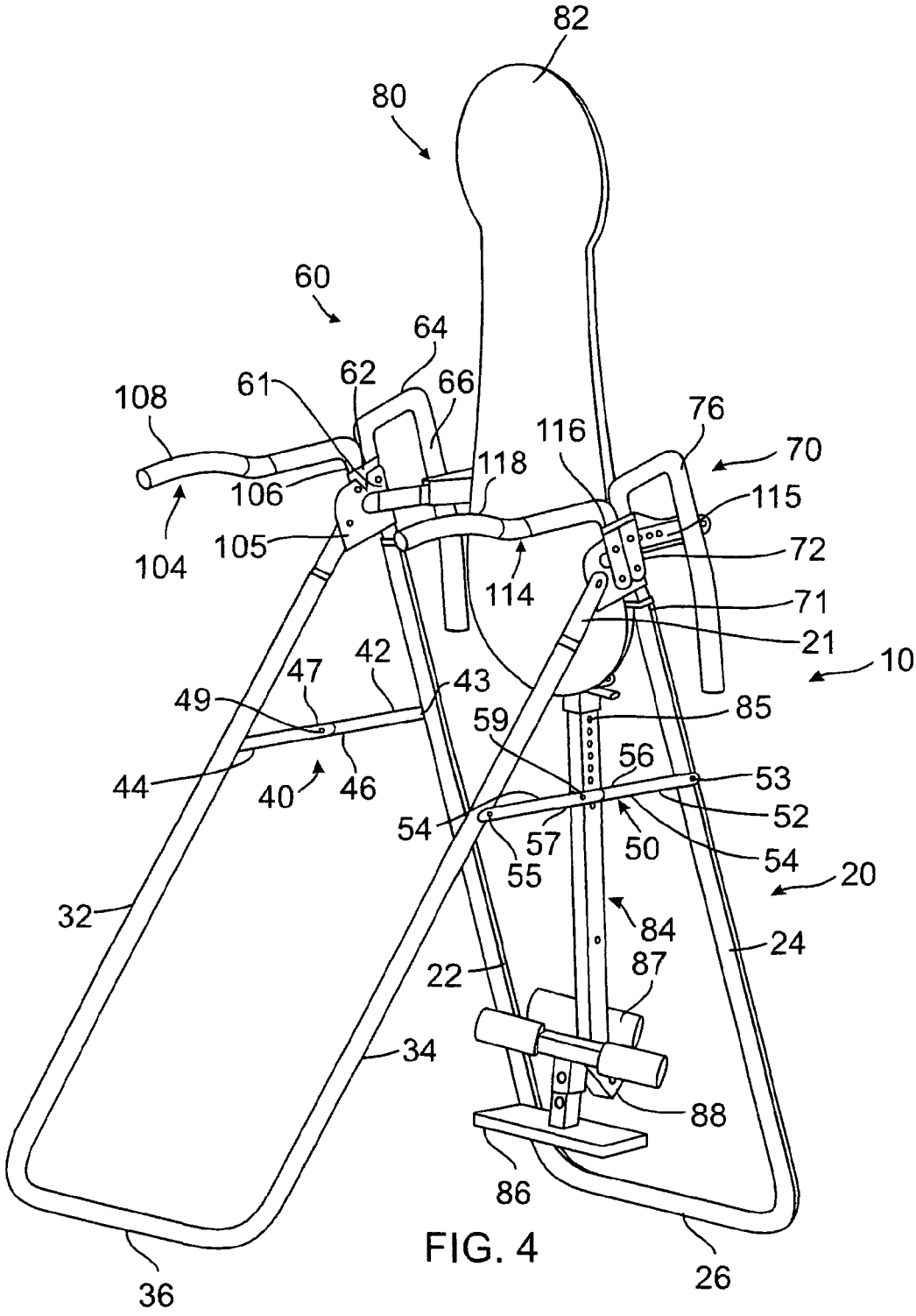
FIG. 4 is a perspective view of the present invention combination abdominal crunch and body inversion exercise machine set up for an abdominal crunch exercise.

Referring to FIG. 4, there is illustrated the present invention exercise machine 10 set up for an abdominal crunch exercise. The only difference between this set-up and the set-up as illustrated in FIG. 1 for a gravity inversion exercise is that the intermediate cross-bar connecting section 38 has been removed so that the height adjustment leg tube 84 does not rest against it and the assembly of the back support 80, height adjustment leg tube 84, foot plate 86 and at least one and preferably two foot retaining members 87 an 88 are free to rotate so that they are vertically oriented as illustrated in FIG. 4. Alternatively, the cross-bar connecting section 38 may be repositioned so it will not stop the height adjustment leg tube 84 in the proper location to initiate the ab-crunch workout, or the height adjustment leg tube 84 can be repositioned.

Figure 5:
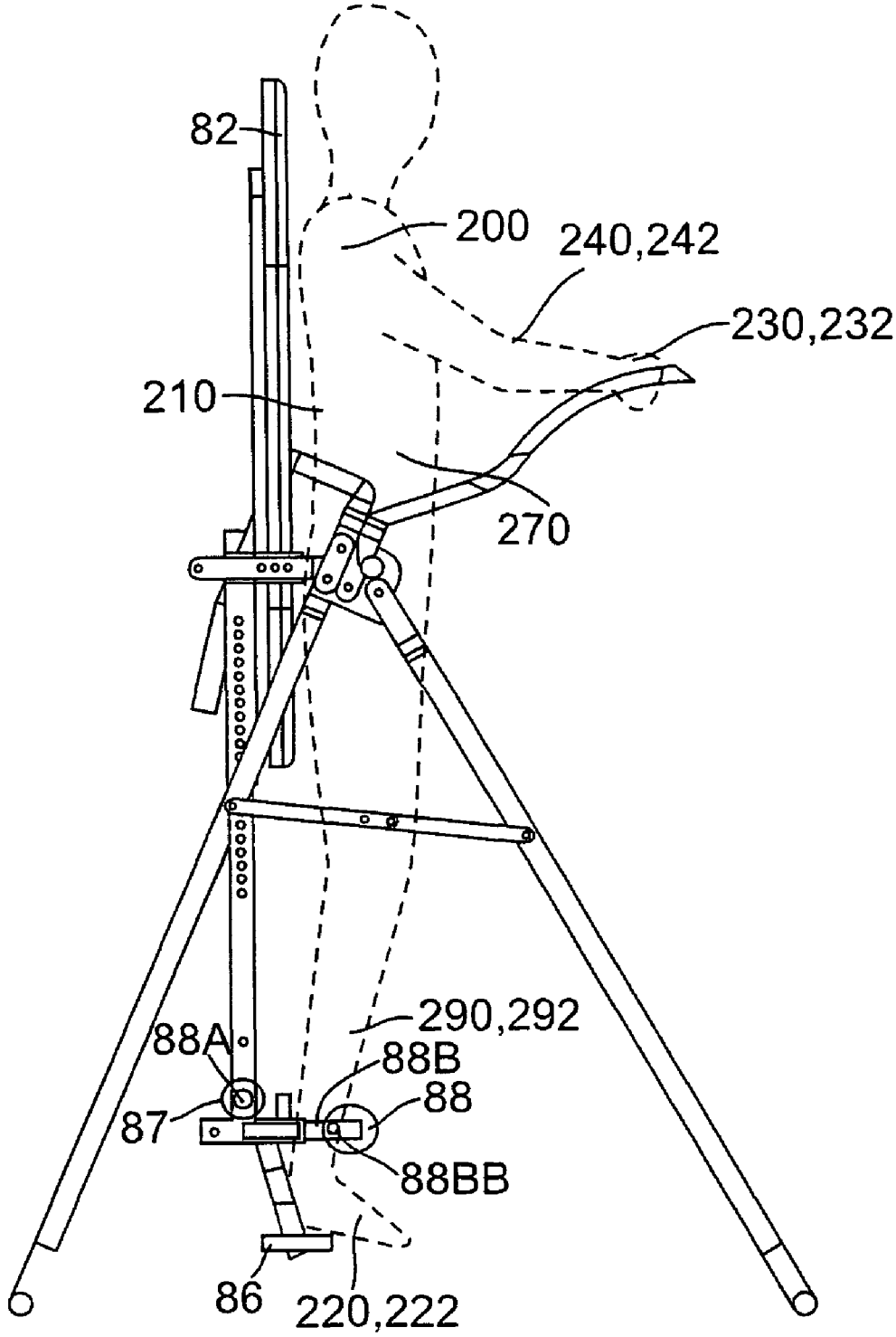
FIG. 5 is a side view of a user on the present invention exercise machine with the machine in the starting position for an abdominal crunch exercise work out.

Referring to FIG. 5, there is illustrated a side view of a user on the present invention exercise machine 10 with the machine in the starting position for an abdominal crunch exercise work out. The user's back 210 rests against the pad 82 of back support 80 and the user's feet 220 and 222 rest on foot plate 86 and are retained between foot retaining members 87 and 88. The only difference between this position and the position illustrated in FIG. 2 is that in FIG. 5 the user 200 is vertically oriented while in FIG. 2 the user 200 was at a 45 degree angle to the horizontal because the height adjustment leg tube 84 was retained against the intermediate cross-bar connecting section 38.

Figure 6:
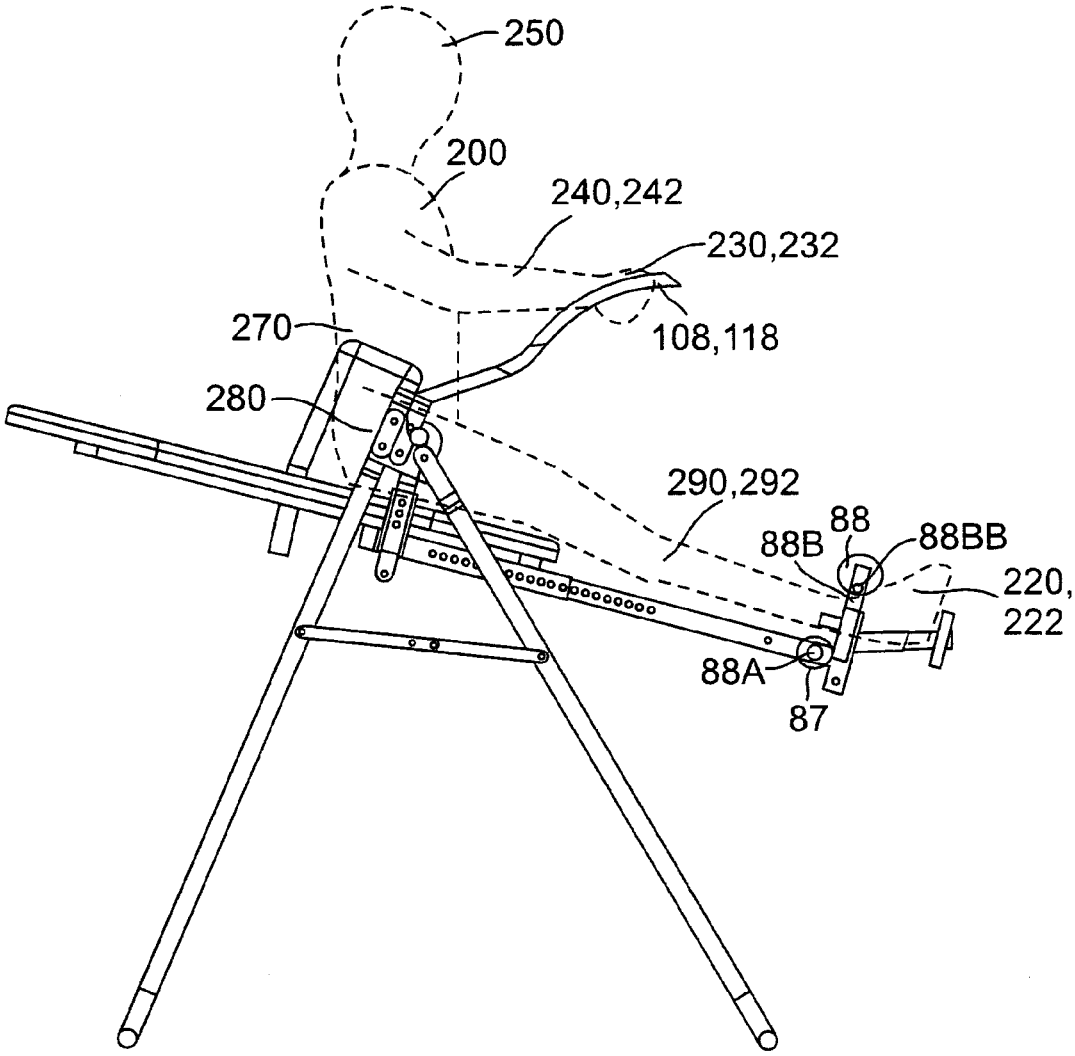
FIG. 6 is a side view of a user on the present invention exercise machine with the machine oriented for a full abdominal exercise work out.

Referring to FIG. 6, the user 200 holds the longitudinal gripping portion 108 of first abdominal crunch handle bar 106 in the user's right hand 230 and holds the longitudinal gripping portion 118 of the second abdominal crunch handle bar 114 is the user's left hand 232 and causes the user's weight to shift so that the back support 80 is rotated so that the user is almost horizontally aligned on the machine 10. The user then rotates his torso 270 towards his legs 290, 292 to exercise his stomach muscles. The user can also release his feet from the at least one or two foot retaining members 87 and 88 and tightly gripping the longitudinal griping portions 108 and 118 cause his legs 290 and 292 to rotate towards his stomach 280 to provide another abdominal exercise.

Therefore, through the use of the present invention, the user can perform both gravity inversion exercises and abdominal crunch exercises on the same machine.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An exercise device comprising:

a. a first support angle leg section having a first longitudinal section, a parallel and spaced apart second longitudinal section, and a bottom interconnecting section, a second support angle leg section having a first longitudinal section, a parallel and spaced apart second longitudinal section, and a bottom interconnecting section, and an intermediate cross-bar connecting section, the two support angle leg sections interconnected by a first hinged connecting member having a first bar with a distal end connected to first longitudinal section of first support angle leg section, a second bar with a distal end connected to first longitudinal section of second support angle leg section and a hinge member interconnecting respective proximal ends of the first and second bars, the two support angle leg sections are interconnected by second hinged connecting member having a first bar with a distal end connected to second longitudinal section of first support angle leg section, a second bar with a distal end connected to second longitudinal section of second support angle leg section and a hinge member interconnecting respective proximal ends of the first and second bars, a first inversion handle bar located at an upper end of first longitudinal section and having a connecting portion, a horizontal portion and a longitudinal gripping portion, a second inversion handle bar connected to a plate located at an upper end of first longitudinal section and having a connecting portion, a horizontal portion and a longitudinal gripping portion, a first abdominal crunch handle bar located at an upper end of second longitudinal section and having a connecting portion and a longitudinal gripping portion, a second abdominal crunch handle bar located at an upper end of second longitudinal section and having a connecting portion and a longitudinal gripping portion, rotatably supported between the supporting angle leg sections is a back support having a pad, extending from the back support is a height adjustment leg tube terminating in a foot plate and having foot retaining members spaced apart from the foot plate, the height adjustment leg tube having an adjustment member whereby the length to the height adjustment tube can be increased or decreased to accommodate the length of a user's legs, the height adjustment leg tube also resting on the intermediate cross-bar connecting section;

b. whereby with the machine in the starting position for an inversion exercise work out, a user's back rests against the pad of the back support and the user's feet rest on the foot plate with the user's feet retained between the foot retaining members, the user causes the user's weight to shift by moving the user's arms so that the back support, height adjustment leg tube, foot plate and foot retaining members are rotated so that the user is supported with the user's head projecting toward the ground and the user's feet are in the air to invert the posture of the user for an inversion exercise;

c. whereby with the intermediate cross-bar connecting section removed or repositioned, the user holds the longitudinal gripping portion of the first abdominal crunch handle bar in the user's right hand and holds the longitudinal gripping portion of the second abdominal crunch handle bar is the user's left hand and causes the user's weight to shift so that the back support is rotated so that the user is almost horizontally aligned on the exercise machine and the user then rotates the user's torso towards the user's legs to exercise the user's stomach muscles and the user can also release feet from the foot retaining members and tightly gripping the longitudinal griping portions cause the user's legs to rotate towards stomach to provide another abdominal exercise; and d. the user can perform both gravity inversion exercises and abdominal exercises on the same exercise machine.

2. The exercise device in accordance with claim 1 wherein the user also has the user's hands respectively grip a longitudinal gripping portion of a respective inversion handle bar for additional support to return to the non-inverted position.

3. An exercise device comprising:

a. a first support angle leg section having a first longitudinal section, a parallel and spaced apart second longitudinal section, and a bottom interconnecting section, a second support angle leg section having a first longitudinal section, a parallel and spaced apart second longitudinal section, and a bottom interconnecting section, and an intermediate cross-bar connecting section, the two support angle leg sections hingeably interconnected, a first inversion handle bar located at an upper end of first longitudinal section and having a longitudinal gripping portion, a second inversion handle bar located at an upper end of first longitudinal section and having a longitudinal gripping portion, a first abdominal crunch handle bar located at an upper end of second longitudinal section and having a longitudinal gripping portion, a second abdominal crunch handle bar located at an upper end of second longitudinal section and having a longitudinal gripping portion, rotatably supported between the supporting angle leg sections is a back support having a pad, extending from the back support is a height adjustment leg tube terminating in a foot plate and having at least one foot retaining member spaced apart from the foot plate, the height adjustment leg tube having an adjustment member whereby the length to the height adjustment tube can be increased or decreased to accommodate the length of a user's legs, the height adjustment leg tube also resting on the intermediate cross-bar connecting section;

b. whereby with the machine in the starting position for an inversion exercise work out, a user's back rests against the pad of the back support and the user's feet rest on the foot plate with the user's feet retained by the at least one foot retaining member, the user causes the user's weight to shift so that the back support, height adjustment leg tube, foot plate and at least one foot retaining member are rotated so that the user is supported with the user's head projecting toward the ground and the user's feet are in the air to invert the posture of the user for an inversion exercise;

c. whereby with the intermediate cross-bar connecting section removed, the user holds the longitudinal gripping portion of the first abdominal crunch handle bar in the user's right hand and holds the longitudinal gripping portion of the second abdominal crunch handle bar is in the user's left hand and causes the user's weight to shift so that the back support is rotated so that the user is almost horizontally aligned on the exercise machine and the user then rotates his the user's torso towards the user's legs to exercise the user's stomach muscles and the user can also release the user's feet from the at least one foot retaining member and tightly gripping the longitudinal griping portions cause the user's legs to rotate towards his stomach to provide another abdominal exercise; and d. the user can perform both gravity inversion exercises and abdominal exercises on the same exercise machine.

4. The exercise device in accordance with claim 3 wherein the user's hands respectively grip a longitudinal gripping portion of a respective inversion handle bar for additional support to return to the non-inverted position.

5. An exercise machine comprising:

a. a combination abdominal crunch and gravity inversion machine;

b. an inversion exercise section including a back support and a foot retaining member which are rotatably supported on at least one support member, the at least one support member supporting both a first inversion handlebar having a connecting portion, a horizontal portion and a longitudinal gripping portion and a second inversion handlebar portion whereby with the machine in a starting position for an inversion exercise work out, a user's back rests against the back support and the user's feet are retained in the foot retaining member and the user causes the user's weight to shift by moving the user's arms so that the back support and foot retaining member are rotated so that the user is supported by the foot retaining member and the user can respectively grasp the horizontal portions of the first and second inversion handlebars with the user's hands with the user's head pointing toward the ground for a gravity inversion exercise; and c. an abdominal crunch section including the back support and the foot support member which are rotatably supported on the at least one support member, the at least one support member supporting both a first abdominal crunch handlebar having a connecting portion and a longitudinal gripping portion and a second abdominal crunch handle bar having a connecting portion and a longitudinal gripping portion, and to initiate an abdominal crunch exercise the user's hands respectively grasp a longitudinal gripping portion of the first and second abdominal crunch handle bars and the user causes the user's weight to shift so that the back support is rotated so that the user is almost horizontally aligned on the exercise machine and the user releases the user's feet from the foot retaining member and rotates the user's feet towards the user's torso.

6. An exercise device comprising:

a. a first support angle leg section having a first longitudinal section, a parallel and spaced apart second longitudinal section, and a bottom interconnecting section, a second support angle leg section having a first longitudinal section, a parallel and spaced apart second longitudinal section, and a bottom interconnecting section, a first inversion handle bar located at an upper end of first longitudinal section and having a longitudinal gripping portion, a second inversion handle bar located at an upper end of first longitudinal section and having a longitudinal gripping portion, a first abdominal crunch handle bar located at an upper end of second longitudinal section and having a longitudinal gripping portion, a second abdominal crunch handle bar located at an upper end of second longitudinal section and having a longitudinal gripping portion, rotatably supported between the supporting angle leg sections is a back support, extending from the back support is a height adjustment leg tube terminating in a foot plate and having at least one foot retaining member spaced apart from the foot plate, the height adjustment leg tube having adjustment means whereby the length to the height adjustment tube can be increased or decreased to accommodate the length of a user's legs;

b. whereby with the machine in the starting position for an inversion exercise work out, a user's back rests against the back support and the user's feet rest on the foot plate with the user's feet retained by the at least one foot retaining member, the user causes the user's weight to shift so that the back support, height adjustment leg tube, foot plate and at least one foot retaining member are rotated so that the user is supported with the user's head projecting toward the ground and the user's feet are in the air to invert the posture of the user for an inversion exercise;

c. whereby with the intermediate cross-bar connecting section removed, the user holds the longitudinal gripping portion of the first abdominal crunch handle bar in the user's right hand and holds the longitudinal gripping portion of the second abdominal crunch handle bar is the user's left hand and causes the user's weight to shift so that the back support is rotated so that the user is almost horizontally aligned on the exercise machine and the user then rotates his torso towards his legs to exercise his stomach muscles and the user can also release his feet from the at least one foot retaining member and tightly gripping the longitudinal griping portions cause the user's legs to rotate towards his stomach to provide another abdominal exercise; and d. the user can perform both gravity inversion exercises and abdominal exercises on the same exercise machine.

* * * * *